United States Patent [19]

Huhn

[11] Patent Number: 4,874,662

[45] Date of Patent: Oct. 17, 1989

[54] PROCESS FOR IMPREGNATING ORGANIC FIBERS

[75] Inventor: Karl Huhn, Burghausen, Fed. Rep. of Germany

[73] Assignee: Wacker-Chemie GmbH, Munich, Fed. Rep. of Germany

[21] Appl. No.: 240,040

[22] Filed: Aug. 26, 1988

[30] Foreign Application Priority Data

Sep. 10, 1987 [DE] Fed. Rep. of Germany ..... 3730413

[51] Int. Cl.[4] ..... B32B 7/00; B32B 25/00; C08G 77/26

[52] U.S. Cl. ..... 428/266; 427/387; 428/447; 528/38

[58] Field of Search ..... 427/387, 389, 389.9, 427/392; 528/21, 34, 38; 428/266, 447

[56] References Cited

U.S. PATENT DOCUMENTS 4,247,592 1/1981 Kalinowski ..... 428/266

4,559,385 12/1985 Huhn et al. ..... 528/38 X

*Primary Examiner*—Michael Lusignan

[57] ABSTRACT

The invention is a process wherein organic fibers are impregnated with organopolysiloxane (1) containing, in addition to diorganosiloxane units in which the two SiC-bonded organic radicals are monovalent hydrocarbon radicals, at least two monovalent SiC-bonded radicals containing basic nitrogen, at least some of the SiC-bonded radical containing basic nitrogen comprising SiC-bonded N-cyclohexylaminoalkyl radicals. The SiC-bonded N-cyclohexylaminoalkyl radicals are in monoorganosiloxane and/or diorganosiloxane and/or triorganosiloxane units. The preferred SiC-bonded N-cyclohexylaminoalkyl radical is the SiC-bonded N-cyclohexyl-3-aminopropyl radical. The organopolysiloxane (1) contains optionally condensable groups which are bonded directly to silicon. The organopolysiloxane (1) containing condensable groups bonded directly to silicon can be employed together with an organopolysiloxane (2a) containing at least 3 Si-bonded hydrogen atoms per molecule, or together with trialkoxy- or tetraalkoxysilanes (2b), and if appropriate, together with a catalyst (3) for the condensation of condensable groups bonded directly to silicon.

26 Claims, No Drawings

PROCESS FOR IMPREGNATING ORGANIC FIBERS

U.S. Pat. No. 4,098,701 and DE-OS No. 3,503,457 (corresponding to U.S. Ser. No. 807,007), disclose compositions for impregnation of organic fibers comprising an organopolysiloxane which contains condensable groups bonded directly to silicon. In addition to diorganosiloxane units in which the two SiC-bonded organic radicals are monovalent hydrocarbon radicals, the compositions contain at least two monovalent SiC-bonded radicals containing basic nitrogen, an organopolysiloxane containing at least three Si-bonded hydrogen atoms per molecule, and a catalyst for the condensation of condensable groups bonded directly to silicon.

The object of the present invention is to provide a process for impregnating organic fibers which gives the fibers a pleasant hand and in which yellowing of the organic fibers is particularly low.

BRIEF DESCRIPTION OF THE INVENTION

The invention relates to a process for impregnating organic fibers with organopolysiloxane (1) which contains, in addition to diorganosiloxane units in which the two SiC-bonded organic radicals are monovalent hydrocarbon radicals, at least two monovalent SiC-bonded radicals containing basic nitrogen, wherein at least some of the SiC-bonded radicals containing basic nitrogen comprise SiC-bonded N-cyclohexylaminoalkyl radicals.

DETAILED DESCRIPTION OF THE INVENTION

In U.S. Pat. No. 4,098,701 and in DE-OS No. 3,503,457 (corresponding to U.S. Ser. No. 807,007), N-alkylaminoalkyl radicals and N-(aminoalkyl)aminoalkyl radicals, but not N-cycloalkylaminoalkyl radicals are disclosed as SiC-bonded radicals containing basic nitrogen.

The process according to the invention can be used to impregnate all organic fibers in the form of filaments, yarns, non-woven fabrics, mats, strands, woven or knitted textiles, which it is possible to impregnate with organosilicon compounds. Examples of fibers which can be impregnated using the process of the invention include keratin fibers, in particular wool, poly(vinyl)alcohol fibers, copolymers of vinyl acetate fibers, cotton fibers, rayon fibers, hemp fibers, natural silk fibers, polypropylene fibers, polyethylene fibers, polyester fibers, polyurethane fibers, nylon fibers, cellulose fibers and mixtures of at least two such fibers. The fibers may be of natural or synthetic origin. The textiles can be in the form of fabric webs or pieces of clothing or parts of pieces of clothing.

In the case of keratin, in particular wool, shrinkage due to felting can be prevented by impregnation according to the process of the invention. The process is particularly effective when the keratin has been pretreated with chlorine, rinsed and neutralized.

In the organopolysiloxane (1), which contains condensable groups bonded directly to the silicon, the diorganosiloxane units in which the two SiC-bonded organic radicals are monovalent hydrocarbon radicals are preferably those which can be represented by the formula $$R_2Si\,(OR^1)_aO_{\frac{2-a}{2}}$$

where R represents identical or different monovalent hydrocarbon radicals, $R^1$ represents hydrogen or radicals which have 1 to 15 carbon atoms per radical containing carbon and hydrogen atoms, and optionally containing an ether oxygen atom and are free of multiple bonds, and a is 0 or 1.

The radicals R preferably contain 1 to 18 carbon atoms per radical. Examples of radicals R are alkyl radicals such as methyl, ethyl, n-propyl, isopropyl, butyl, octyl, tetradecyl and octadecyl radicals; aliphatic hydrocarbon radicals having at least one double bond, such as the vinyl, allyl and butadienyl radicals; cycloaliphatic hydrocarbon radicals, such as the cyclohexyl radical; aromatic hydrocarbon radicals, such as the phenyl and naphthyl radicals; alkaryl radicals, such as tolyl radicals; and aralkyl radicals, such as the benzyl radical.

Due to their ready availability, compounds in which at least 80 percent of the SiC-bonded hydrocarbon radicals in the organopolysiloxane (1) are methyl radicals are preferred.

The examples of hydrocarbon radicals R, which have a maximum of 15 carbon atoms per radical and are free of multiple bonds, also apply fully to the hydrocarbon radicals $R^1$, the methyl, ethyl and isopropyl radicals being preferred. A preferred example of a radical $R^1$ comprising carbon and hydrogen atoms and an ether oxygen is the radical of the formula $$CH_3O(CH_2)_2-.$$

The preferred organopolysiloxanes (1) contain at least 100 diorganosiloxane units per molecule in which the two SiC-bonded organic radicals are monovalent hydrocarbon radicals.

In the organopolysiloxane (1), which contains condensable groups bonded directly to silicon, the Si-C-bonded N-cyclohexylaminoalkyl radicals are present in monoorganosiloxane and/or diorganosiloxane and/or triorganosiloxane units, which can preferably be represented by the formula $$C_6H_{11}NHR^2Si\,(OR^1)_bO_{\frac{3-b}{2}}$$

$$(C_6H_{11}NHR^2)RSi\,(OR^1)_aO_{\frac{2-a}{2}}$$

$$(C_6H_{11}NHR^2)R_2SiO_{\frac{1}{2}}$$

where R, $R^1$ and a have the above definitions, $R^2$ represents identical or different divalent hydrocarbon radicals, and b is 0, 1 or 2.

In particular, due to their availability, compounds wherein $R^2$ is $-(CH_2)_3-$ are particularly preferred.

Further examples of radicals $R^2$ are those of the formula $$-CH_2-$$

$$-(CH_2)_2-$$

$$-(CH_2)_4-$$

-continued

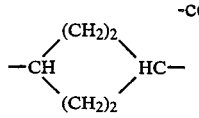

$-CH_2CH(CH_3)CH_2-$ $-C_6H_4-$ and $-CH_2CH{=}CHCH_2-$.

The particularly preferred SiC-bonded N-cyclohexylaminoalkyl radical is the SiC-bonded N-cyclohexyl-3-aminopropyl radical.

In the organopolysiloxane (1), which optionally contains condensable groups bonded directly to silicon, further monoorganosiloxane and/or diorganosiloxane and/or triorganosiloxane units which contain a SiC-bonded radical containing basic nitrogen are not excluded. Preferred compounds are those of the formula $$R_2^3NR^2Si\,(OR^1)_bO_{\frac{3-b}{2}}$$

$$R_2^3NR^2RSi\,(OR^1)_aO_{\frac{2-a}{2}}$$

$$R_2^3NR^2R_2SiO_{\frac{1}{2}},$$

where R, $R^1$, $R^1$, a and b are as defined hereinbefore, and $R^3$ denotes hydrogen or identical or different alkyl or aminoalkyl or iminoalkyl radicals.

Examples of alkyl radicals $R^3$ are the methyl, ethyl, n-propyl, isopropyl, butyl, octyl, tetradecyl and octadecyl radicals.

Examples of aminoalkyl radicals $R^3$ are those of the formula $H_2N(CH_2)_2-$ $H_2N(CH_2)_2NH(CH_2)_3-$ $H_2N(CH_2)_3-$ $(CH_3)_2N(CH_2)-$ $H_2N(CH_2)_5-$ $H(NHCH_2CH_2)_3-$ and $n\text{-}C_4H_9NHCH_2CH_2NHCH_2CH_2-$.

The number of siloxane units in the organopolysiloxane (1) containing a SiC-bonded radical containing basic nitrogen is preferably 0.4 percent to 6 percent of the number of diorganosiloxane units in which the two SiC-bonded organic radicals are monovalent hydrocarbon radicals.

It is possible to employ one organopolysiloxane (1), but it is also possible to employ a mixture of at least two different organopolysiloxanes (1).

The organopolysiloxane (1), or a mixture of at least two different organopolysiloxanes (1), preferably has an average viscosity of from about 100 to about 10,000 mPa.s at 25° C., particularly preferably from about 1,000 to about 5,000 mPa.s at 25° C.

If the organopolysiloxane (1) contains condensable groups bonded directly to silicon, it can be employed together with (2a) an organopolysiloxane containing at least 3 Si-bonded hydrogen atoms per molecule, and (3), if appropriate, a catalyst for the condensation of condensable groups bonded directly to silicon. It is, likewise, possible to employ an organopolysiloxane of this type together with (2b) a trialkoxy- or tetra-alkoxysilane and (3), if appropriate, a catalyst for the condensation of condensable groups bonded directly to silicon.

The preparation of the organopolysiloxanes (1) can take place in any manner known, per se, for the preparation of organopolysiloxanes containing monovalent SiC-bonded radicals containing basic nitrogen.

In the organopolysiloxane (2a), which contains at least 3 Si-bonded hydrogen atoms per molecule and can be employed in the process according to the invention in combination with an organopolysiloxane (1) containing condensable groups bonded directly to silicon, the silicon valencies satisfied other than by hydrogen and siloxane oxygen atoms are preferably satisfied by methyl, ethyl or phenyl radicals or by a mixture of at least two such hydrocarbon radicals. It is furthermore preferred that one of the abovementioned preferred hydrocarbon radicals is bonded to each silicon atom to which a hydrogen atom is bonded.

Particularly preferred organopolysiloxanes (2a) containing at least 3 Si-bonded hydrogen atoms per molecule are those of the formula $$(CH_3)_3SiO(SiR_2^4O)_pSi(CH_3)_3$$

in which $R^4$ represents hydrogen or a methyl, ethyl or phenyl radical, and p denotes an integer having a value from about 10 to about 500, with the proviso that a maximum of one hydrogen atom is bonded to a silicon atom and that the ratio between the $R_2^4SiO$ units in which both $R^4$ are hydrocarbon radicals and the units containing Si-bonded hydrogen is 3:1 to 1:4. Preferably, $R^4$ is a methyl radical if it is not hydrogen.

The organopolysiloxanes (2a) containing at least 3 Si-bonded hydrogen atoms per molecule may also be identical or different molecules of this type of organopolysiloxane.

The organopolysiloxane (2a) is preferably employed in amounts of from 0.01 to 0.20 parts by weight of Si-bonded hydrogen per 100 parts by weight of organopolysiloxane (1).

Trialkoxy- or tetraalkoxysilanes (2b) which can be employed in the process according to the invention in combination with an organopolysiloxane (1) containing condensable groups bonded directly to silicon are preferably those of the formula $$RSi(OR^1)_3 \text{ or } Si(OR^1)_4$$

or partial hydrolysates of trialkoxy- or tetraalkoxysilanes having up to 10 silicon atoms per partial hydrolysate, where R and $R^1$ have the abovementioned meaning for R and $R^1$, respectively.

The trialkoxy- or tetraalkoxysilane (2b) is preferably employed in amounts from 1 to 20 parts by weight per 100 parts by weight of the organopolysiloxane (1).

As catalysts (3) for the condensation of condensable groups bonded directly to silicon, any catalyst for the condensation of condensable groups bonded directly to silicon can be employed in the process according to the invention. Examples of such catalysts include carboxylic acid salts of tin or zinc, it being possible for hydrocarbon radicals to be bonded directly to tin, such as di-n-butyltin dilaurate, tin octanoates, di-2-ethyltin dilaurate, di-n-butyltin di-2-ethylhexanoate, di-2-ethylhexyltin di-2-ethylhexanoate, dibutyl- or dioctyltin diacylates, each of the acylate groups being derived from alkanoic acids having 3 to 16 carbon atoms in which at least two of the valences of the carbon atoms bonded to the carboxyl group being satisfied by at least two carbon atoms other than those of the carboxyl group and zinc octanoates.

Further examples of catalysts (3) include alkoxytitanates, such as butyl titanates, and triethanolamine titanate, and also zirconium compounds.

The catalysts (3) employed can also comprise mixtures of catalysts.

The catalyst (3) is preferably employed in amounts of from 1 to 10 parts by weight per 100 parts by weight of the organopolysiloxane (1).

In addition to the abovementioned compositions (1), (2a), (2b) and (3), additional compositions conventionally used for impregnation of organic fibers, can optionally be used in the process according to the invention. Examples of such additional compositions include dimethylpolysiloxanes which contain an Si-bonded hydroxyl group in each of the terminal units and have a maximum viscosity of 10,000 mPa.s at 25° C., dimethylpolysiloxanes which are terminated by trimethylsiloxy groups and have a maximum viscosity of 10,000 mPa.s at 25° C., and if the fibers to be impregnated, at least partly comprise cellulose or cotton, the "crease-resist finishes", such as dimethyldihydroxyethyleneurea (DMDHEU) mixed with zinc nitrate or magnesium chloride.

The compositions employed in the process according to the invention may be applied to the fibers undiluted, or in the form of solutions in organic solvents, or in the form of aqueous emulsions. If aqueous emulsions are employed in the process, these in addition to the organopolysiloxanes at the process, emulsions can contain, in addition to water, dispersants and thickeners, such as poly-N-vinylpyrrolidone. The compositions employed in the process according to the invention are preferably applied in the form of aqueous emulsions to the fibers to be impregnated. Preferred dispersants in these dispersions are nonionic and cationic emulsifiers. The preparation of emulsions is well known in the art.

The compositions used in the process of the invention can be applied to the fibers in any manner which is suitable and in many cases known for the impregnation of fibers, for example, by, dipping, brushing, pouring, spraying, including spraying from aerosol packs, rolling on, padding or printing.

The compositions used in the process of the invention are preferably applied in amounts such that the increase in weight of the fibers due to the compositions, minus the diluents which may optionally be present is 1 to 20 percent by weight, relative to the weight of the fibers.

The crosslinking on the fibers of the organosilicon compounds employed in the process according to the invention which occurs when components (2a) or (2b), and if appropriate, (3) are used takes place at room temperature. It can be accelerated by warming, for example to 50° to 180° C.

In the following parts of the description, all indications of parts and percentages are by weight, unless otherwise specified.

EXAMPLE 1

(a) A mixture of 4.5 parts of a silane of the formula $$C_6H_{11}NH(CH_2)_3SiCH_3(OCH_3)_2$$

and 150 parts of a mixture of cyclic dimethylpolysiloxanes containing 3 to 10 siloxane units per molecule and 0.03 parts of a 40 percent strength solution of benzyltrimethylammonium hydroxide in methanol was warmed for 4 hours at 80° C. under nitrogen with stirring. The quaternary ammonium hydroxide was then deactivated by warming for 60 minutes at 150° C. at 13 hPa (abs.), and the organopolysiloxane was simultaneously freed from components which boil under these conditions. The organopolysiloxane obtained contains methoxy groups as condensable groups bonded directly to silicon, and in addition to dimethylsiloxane units, contained diorganosiloxane units containing an SiC-bonded N-cyclohexyl-3-aminopropyl radical. It has a viscosity of 1,200 mPa.s at 25° C. and an amine number (=number of ml of 1N HCl necessary to neutralize 1 g of the substance) of 0.15.

(b) 35 parts of the organopolysiloxane as prepared above under (a) were emulsified in 61 parts of water using, as dispersant, 4 parts of polyglycol ether prepared by reacting tributylphenol (1 mol) with ethylene oxide (13 mol).

EXAMPLE 2

(a) The procedure described in Example 1 under (a) was repeated, with the modification that the 9.0 parts of the silane of the formula $$C_6H_{11}NH(CH_2)_3SiCH_3(OCH_3)_2$$

were used. The organopolysiloxane obtained contained methoxy groups as condensable groups bonded directly to silicon, and in addition to dimethylsiloxane units, contained diorganosiloxane units containing an SiC-bonded N-cyclohexyl-3-aminopropyl radical. It had a viscosity of 1150 mPa.s at 25° C. and an amine number of 0.29.

(b) An emulsion was prepared as described in Example 1 under (b) using the organopolysiloxane prepared as described above under (a).

EXAMPLE 3

(a) The procedure described in Example 1 under (a) was repeated, with the modification that 10 parts of the silane of the formula $$C_6H_{11}NH(CH_2)_3SiCH_3(OCH_3)_2$$

and 90 parts of the same mixture of cyclic dimethylpolysiloxanes as used in Example 1 were used. The organopolysiloxane obtained contained methoxy groups as condensable groups bonded directly to silicon, and in addition to dimethylsiloxane units, contained diorganosiloxane units containing an SiC-bonded N-cyclohexylaminopropyl radical. It had a viscosity of 830 mPa.s at 25° C. and an amine number of 0.62.

(b) 35 parts of the organopolysiloxane prepared in (a) were emulsified in 61 parts of water using, as dispersant, 6 parts of polyglycol ether prepared by reacting tributylphenol (1 mol) with ethylene oxide (8 mol).

EXAMPLE 4

(a) The procedure described in Example 1 under (a) was repeated, with the modification that the 4.5 parts of the silane of the formula $$C_6H_{11}NH(CH_2)_3SiCH_3(OCH_3)_2$$

were replaced by 4.7 parts of a silane of the formula $C_6H_{11}NH(CH_2)_3Si(OCH_3)_3$ The organopolysiloxane obtained contained methoxy groups as condensable groups bonded directly to silicon, and in addition to dimethylsiloxane units, contained monoorganosiloxane units containing an SiC-bonded N-cyclohexyl-3-aminopropyl radical. It has a viscosity of 1,220 mPa.s at 25° C. and an amine number of 0.14.

(b) An emulsion was prepared as described in Example 1 under (b) using the organopolysiloxane whose preparation is described above under (a).

COMPARATIVE EXPERIMENT 1

(a) The procedure described in Example 1 under (a) was repeated, with the modification that the 4.5 parts of the silane of the formula $C_6H_{11}NH(CH_2)_3SiCH_3(OCH_3)_2$ were replaced by 2 parts of a silane of the formula $NH_2(CH_2)_2NH(CH_2)_3SiCH_3(OCH_3)_2$ The organopolysiloxane obtained contained methoxy groups as condensable groups bonded directly to silicon, and in addition to dimethylsiloxane units, contained diorganosiloxane units containing an SiC-bonded N-(2-aminoethyl)-3-aminopropyl radical. It had a viscosity of 1,050 mPa.s at 25° C. and an amine number of 0.14.

(b) An emulsion was prepared as described in Example 1 under (b) using the organopolysiloxane prepared under (a).

COMPARATIVE EXPERIMENT 2

(a) The procedure described in Example 1 under (a) was repeated, with the modification that the 4.5 parts of the silane of the formula $C_6H_{11}NH(CH_2)_3SiCH_3(OCH_3)_2$ were replaced by 4.3 parts of a silane of the formula $NH_2(CH_2)_2NH(CH_2)_3SiCH_3(OCH_3)_2$ The organopolysiloxane obtained contained methoxy groups as condensable groups bonded directly to silicon, and in addition to dimethylsiloxane units, contained diorganosiloxane units containing an SiC-bonded N-(2-aminoethyl)-3-aminopropyl radical. It had a viscosity of 1,020 mPa.s at 25° C. and an amine number of 0.27.

(b) An emulsion was prepared as described in Example 1 under (b) using the organopolysiloxane prepared above under (a).

COMPARATIVE EXPERIMENT 3

(a) The procedure described in Example 1 under (a) was repeated, with the modification that the 4.5 parts of the silane of the formula $C_6H_{11}NH(CH_2)_3SiCH_3(OCH_3)_2$ were replaced by 4.8 parts of a silane of the formula $NH_2(CH_2)_2NH(CH_2)_3SiCH_3(OCH_3)_2$ and the 150 parts of the mixture of cyclic dimethylpolysiloxanes containing 3 to 10 siloxane units per molecule were replaced by 100 parts of the mixture of cyclic dimethylpolysiloxanes. The organopolysiloxane obtained contained methoxy groups as condensable groups bonded directly to silicon, and in addition to dimethylsiloxane units, contained diorganosiloxane units containing an SiC-bonded N-(2-aminoethyl)-3-aminopropyl radical. It had a viscosity of 960 mPa.s at 25° C. and an amine number of 0.60.

(b) An emulsion was prepared as described in Example 1 under (b) using the organopolysiloxane prepared above under (a).

COMPARATIVE EXPERIMENT 4

An emulsion was prepared as described in Example 1 under (b) using a dimethylpolysiloxane which contained an Si-bonded hydroxyl group in each of the terminal units and a viscosity of 1,010 mPa.s at 25° C.

EXAMPLE 5

Separate white cotton fabrics having a weight of 180 g/m$^2$ were each dipped into one of emulsions E1, E2, E3 and E4 each containing 30 g/l of the emulsion whose preparation is described in Examples 1, 2, 3 and 4, respectively, and made up with water. Likewise, separate white cotton fabrics having a weight of 180 g/m$^2$ were each dipped into one of emulsions CE1, CE2, CE3 and CE4 each containing 30 g/l of the emulsion whose preparation is described in Comparative Experiments 1, 2, 3 and 4, respectively, and made up with water. Each of the cotton fabrics was wrung out to a liquid uptake of 74 percent. The cotton fabrics impregnated in this way were subsequently warmed at 150° C. for 10 minutes.

The hand and yellowing of the impregnated cotton fabrics thus obtained is shown in Tables 1 and 2.

TABLE I

Assessment of Hand

E1=E2=E4=VE1=VE2>E3=Ve3>>VE4

The hand was assessed as equally good for the cotton fabrics impregnated with emulsions E1, E2, E4, VE1 and VE2, but better than for the cotton fabrics impregnated with emulsions E3 and VE3 and much better than for the cotton fabrics impregnated with emulsion VE4.

TABLE II

Assessment of Yellowing

White cotton fabric impregnated with emulsion.

| E1 | E2 | E3 | E4 | VE1 | VE2 | VE3 | VE4 | without[1)] |
|---|---|---|---|---|---|---|---|---|
| Berger degree of whiteness. | | | | | | | | |
| 76.1 | 76.3 | 76.5 | 76.8 | 74.7 | 74.5 | 71.5 | 76.6 | 76.5 |

[1)]Non-impregnated white cotton fabric.

The determination of the degree of whiteness is described in A. Berger, Die Farbe [Colour], volume 8, 1959, pages 187–202. A value of 76.5 was determined for the non-impregnated white cotton fabric. Values lower than 76.5 characterize yellowing of the fabric, higher values characterize a white fabric.

It can be seen from the data in the tables that the process of the present invention provides treated fabrics which have a superior hand and non-yellowing properties.

What is claimed is:

1. A process for treating an organic fiber which comprises: Impregnating the organic fiber with a composition comprising an organopolysiloxane (1) containing, in addition to diorganosiloxane units in which the two SiC-bonded organic radicals are monvalent hydrocarbon radicals, at least two monovalent SiC-bonded radicals containing basic nitrogen wherein at least a portion of the SiC-bonded radicals containing basic nitrogen comprise SiC-bonded N-cyclohexylaminoalkyl radicals.

2. A process of claim 1, wherein the SiC-bonded N-cyclohexylaminoalkyl radicals are present in at least one of monoorganosiloxane, diorganosiloxane and triorganosiloxane units.

3. A process of claim 1, wherein the SiC-bonded N-cyclohexylaminoalkyl radical is an N-cyclohexyl-3-aminopropyl radical.

4. A process of claim 2, wherein the SiC-bonded N-cyclohexylaminoalkyl radical is an N-cyclohexyl-3-aminopropyl radical.

5. A process of claim 1, wherein the organopolysiloxane (1) contains condensable groups bonded directly to silicon.

6. A process of claim 2, wherein the organopolysiloxane (1) contains condensable groups bonded directly to silicon.

7. A process of claim 3, wherein the organopolysiloxane (1) contains condensable groups bonded directly to silicon.

8. A process of claim 5, wherein the composition further comprises an organopolysiloxane (2a) containing at least 3 Si-bonded hydrogen atoms per molecule.

9. A process of claim 6, wherein the composition further comprises an organopolysiloxane (2a) containing at least 3 Si-bonded hydrogen atoms per molecule.

10. A process of claim 7, wherein the composition further comprises an organopolysiloxane (2a) containing at least 3 Si-bonded hydrogen atoms per molecule.

11. A process of claim 5, wherein the composition further comprises at least one of trialkoxysilane and tetraalkoxysilane.

12. A process of claim 6, wherein the composition further comprises at least one of trialkoxysilane and tetraalkoxysilane.

13. A process of claim 7, wherein the composition further comprises at least one of trialkoxysilane and tetraalkoxysilane.

14. A process of claim 8 further comprising a catalyst (3) for condensation of the condensable groups bonded directly to silicon.

15. A process of claim 10 further comprising a catalyst (3) for condensation of the condensable groups bonded directly to silicon.

16. A process of claim 11 further comprising a catalyst (3) for condensation of the condensable groups bonded directly to silicon.

17. A process of claim 13 further comprising a catalyst (3) for condensation of the condensable groups bonded directly to silicon.

18. A process of claim 1, wherein the impregnated fiber is heated.

19. A treated fiber of the process of claim 1.

20. A treated fiber of the process of claim 3.

21. A treated fiber of the process of claim 5.

22. A treated fiber of the process of claim 7.

23. A treated fiber of the process of claim 8.

24. A treated fiber of the process of claim 10.

25. A treated fiber of the process of claim 11.

26. A treated fiber of the process of claim 13.

* * * * *